US011426049B2

(12) United States Patent
McDonnell

(10) Patent No.: US 11,426,049 B2
(45) **Date of Patent: *Aug. 30, 2022**

(54) MULTI-SURFACE SPRAY MOP AND MOP SUPPORTING STAND

(71) Applicant: For Life Products, LLC, Miramar, FL (US)

(72) Inventor: Joseph A. McDonnell, Weston, FL (US)

(73) Assignee: For Life Products, LLC, Earth City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/328,024

(22) Filed: May 24, 2021

(65) Prior Publication Data

US 2021/0274992 A1 Sep. 9, 2021

Related U.S. Application Data

(63) Continuation of application No. 16/390,465, filed on Apr. 22, 2019, now Pat. No. 11,013,392.

(60) Provisional application No. 62/661,469, filed on Apr. 23, 2018.

(51) Int. Cl.

| | |
|---|---|
| ***A47L 13/22*** | (2006.01) |
| ***A47L 13/51*** | (2006.01) |
| ***A47L 13/254*** | (2006.01) |
| ***A47L 13/50*** | (2006.01) |
| ***A47L 13/512*** | (2006.01) |

(52) U.S. Cl.

CPC ..... *A47L 13/22* (2013.01); *A47L 13/254* (2013.01); *A47L 13/51* (2013.01); *A47L 13/50* (2013.01); *A47L 13/512* (2013.01)

(58) Field of Classification Search

CPC ..... A47L 13/22; A47L 13/51; A47L 13/254; A47L 13/12; A47L 13/20; A47L 13/50; A47L 13/24; A47L 13/258; A47L 13/512; A47L 13/256

USPC ..... 248/121, 110–113; 15/115, 118

See application file for complete search history.

(56) References Cited

U.S. PATENT DOCUMENTS 5,335,799 A * 8/1994 Coudron ..... A47F 7/0021 211/70.6

* cited by examiner

*Primary Examiner* — David J Walczak

(74) *Attorney, Agent, or Firm* — Merchant & Gould P.C.

(57) ABSTRACT

A multi-surface spray mop system having a spray mop and mop stand. The mop having an elongated segmented body with at least an upper pole section and a lower pole section releasably coupled. The mop stand supports and maintains the spray mop in an upright position above a floor surface by maintaining the center of gravity of the spray mop within a base of a support area defined by the mop supporting stand.

14 Claims, 8 Drawing Sheets

MULTI-SURFACE SPRAY MOP AND MOP SUPPORTING STAND

CROSS REFERENCES TO RELATED APPLICATIONS

This application is a continuation of U.S. patent application Ser. No. 16/390,465, now issued as U.S. Pat. No. 11,013,392, filed on Apr. 22, 2019, which claims benefit under 35 U.S.C. § 1.119(b) of U.S. provisional patent application Ser. No. 62/661,469, filed Apr. 23, 2018, entitled "MULTI-SURFACE SPRAY MOP AND MOP SUPPORTING STAND."

FIELD OF TECHNOLOGY

The present disclosure generally relates to a spray mop that can be used on various surfaces such as hardwood, laminate, vinyl, granite, stone, marble, tile floors, and carpet and a compact mop supporting stand, and more particularly relates to a mop supporting stand for storing the spray mop and other cleaning tools in a clean and compact way.

BACKGROUND

It is known that, to clean the surface of a floor, a mop and/or brush-like cleaning tools may be effectively used. Typically, an appropriate amount of water and cleaning solution may be used on a mop head or a brush head for each cleaning operation followed by thorough rinsing, cleaning and wringing/drying of these parts after use. However, storing a wet or damp mop or other cleaning tools in a storage area or closet may cause stains and/or water damage on the floor, and can often lead to unpleasant odors as well as the spreading of bacteria.

Accordingly, there is a need for a spray mop that can be used on various surfaces and a mop supporting stand that allows for wet or damp mop and other cleaning tools to drain and dry in a clean and compact way.

SUMMARY

The present disclosure provides a spray mop system that can be used for dusting, scrubbing and cleaning on various surfaces such as hardwood, laminate, vinyl, granite, stone, marble, tile floors, and carpet. Among other features, the mop system may include machine washable, microfiber dusting and cleaning pads, a super scrub pad and click-in grout brush that may be configured to attach to a flexible swivel mop head. A light-weight aluminum mop handle may feature a comfortable power grip with mechanical trigger to activate a gentle mist nozzle, and a soft support grip that helps users glide the mop easily over floors and maneuver under limited space. Interchangeable bottle adaptors allow users to rotate various floor cleaning products for different floor surfaces. Moreover, a compact mop supporting stand may be used to allow the mop to maintain an upright position for storage and drying purposes. Such supporting stand may also be used to store other cleaning tools such as brushes and cleaning towels, and mop pads.

The above simplified summary of example aspects serves to provide a basic understanding of the present disclosure. This summary is not an extensive overview of all contemplated aspects, and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplary pointed out in the claims.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Figure 1:
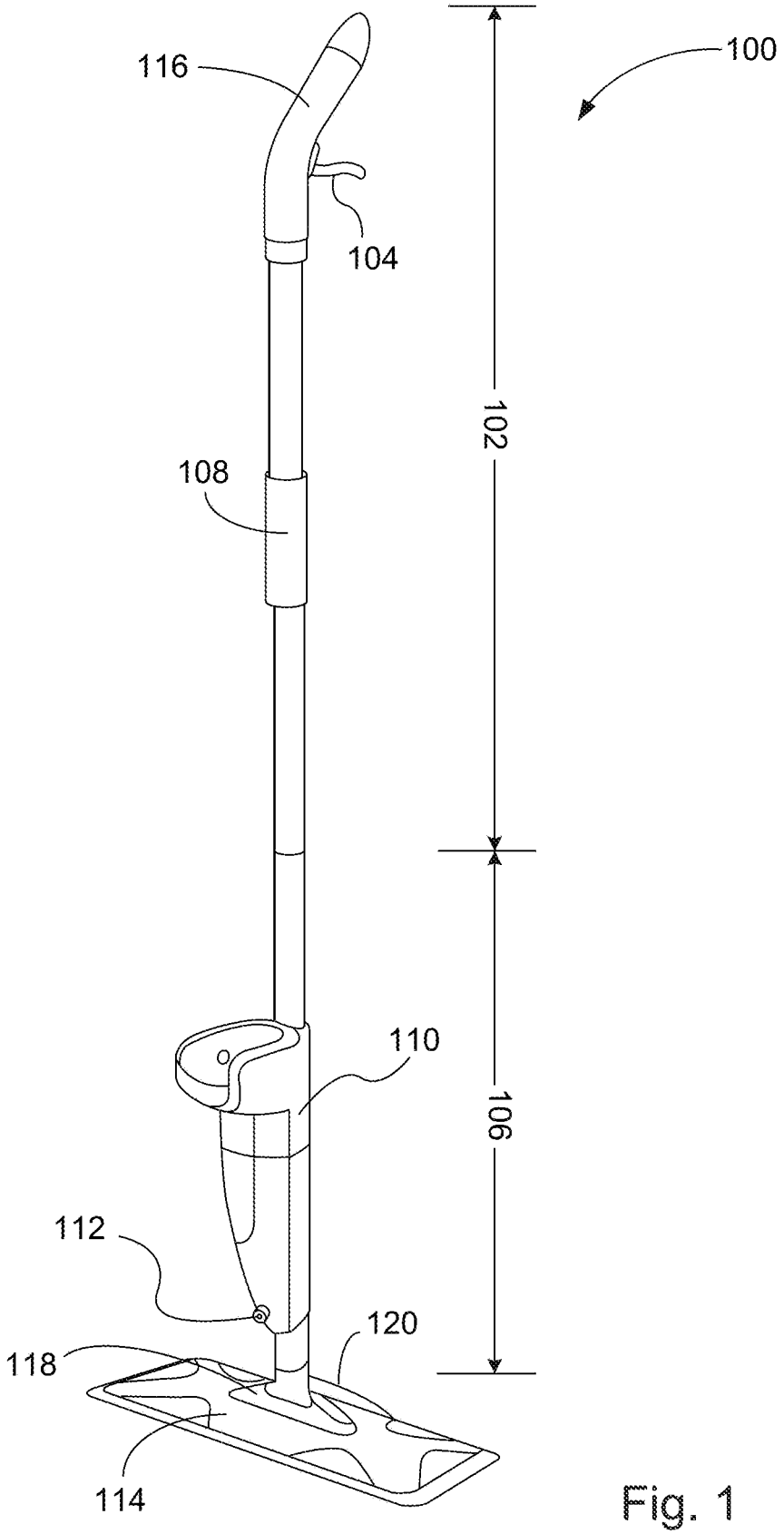
FIG. 1 illustrates a multi-surface spray mop, according to an exemplary aspect.

Various aspects of the disclosure will be described with reference to the drawings, wherein like reference numerals are used to refer to like elements throughout. In the following description, for purposes of explanation, numerous specific details are set forth in order to promote a thorough understanding of one or more aspects of the disclosure. It may be evident in some or all instances, however, that any aspects described below can be practiced without adopting the specific design details described below.

Referring to FIG. 1, according to aspects of the present disclosure, a multi-surface spray mop 100 may include an upper pole section 102, a spray trigger 104, a lower pole section 106, a soft support grip portion 108 positioned on the shaft of the upper pole section 102, a bottle reservoir 110 with a directional mist nozzle 112 on its front surface, and a mop base 114. Via, e.g., a lock notch or other suitable means, the upper pole section 102, the lower pole section 106, and the mop base 114 may be readily assembled together to form a mop with an integral elongated body and dissembled into separate pieces for easy storage. An angled ergonomic mop handle 116 may be provided at one distal end of the upper pole section 102 for a user to guide the spray mop 100 in a desired direction with reduced hand and wrist strain. The soft support grip portion 108 positioned on the shaft of the upper pole section 102 may provide a secondary handhold. The lower pole section 106 may comprise a first distal end for connecting with the upper pole section 102, and a second distal end having a protruding coupling portion for connecting with the mop base 114 or a brush. The mop base 114 includes a swivel joint 118 that allows a user to use the handle of the mop 100 to move back and forth along a desired path.

Figure 2:
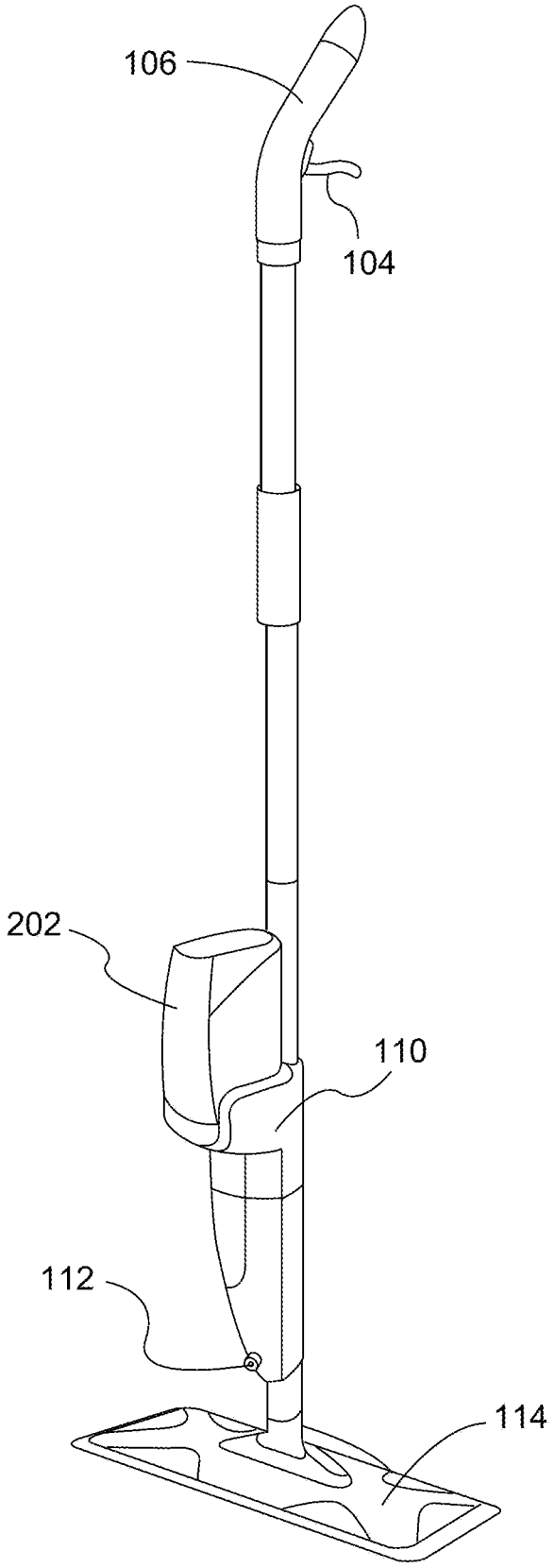
FIG. 2 illustrates a multi-surface spray mop with a cleaning liquid bottle inserted into a bottle reservoir of the multi-surface spray mop, according to an exemplary aspect.
Figure 3:
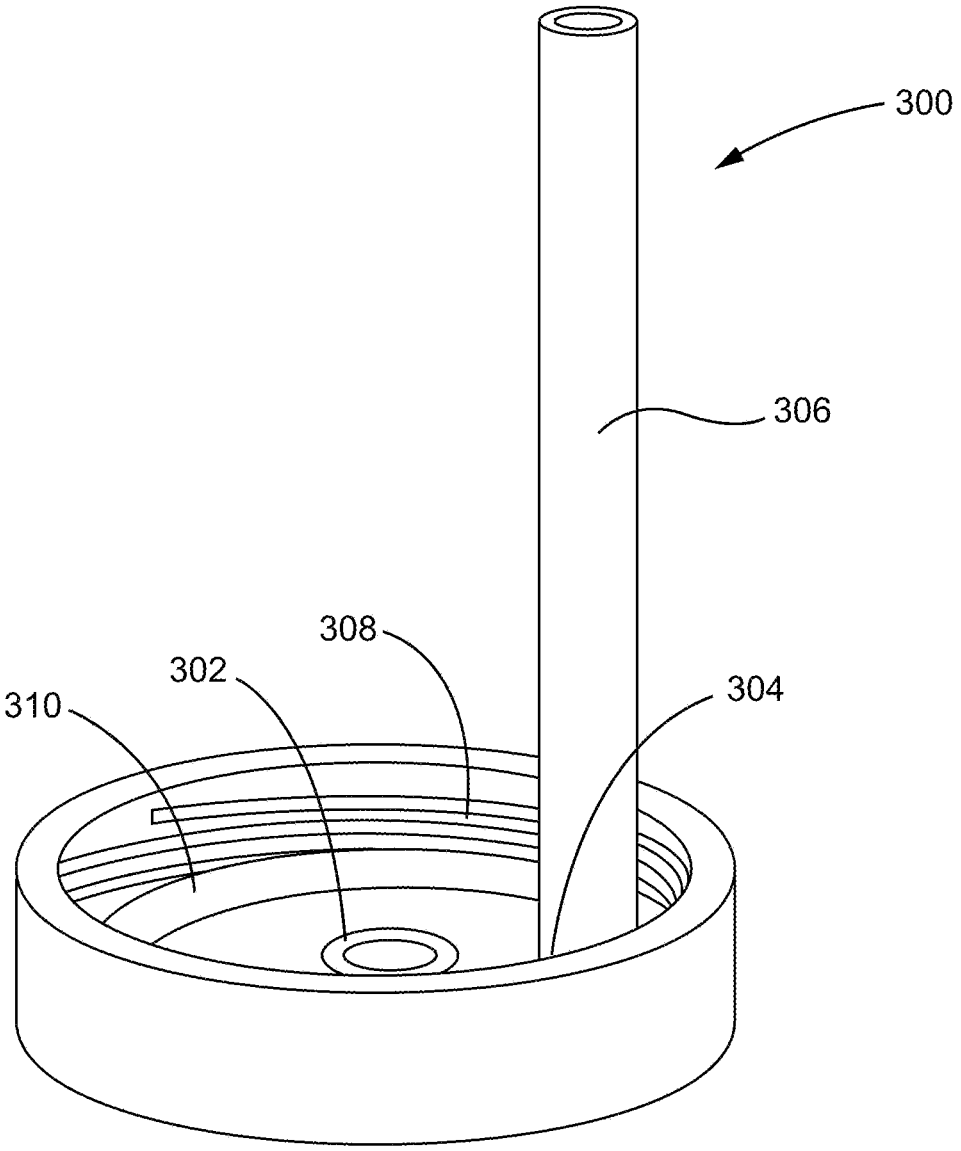
FIG. 3 illustrates a bottle adaptor, according to an exemplary aspect.

The bottle reservoir 110 on the lower pole section 106 may receive and retain a cleaning liquid bottle 202, as shown in FIG. 2, when the spray mop 100 is in use. The nozzle 112 may be generally directed forward and downward so that cleaning liquid drawn out of the bottle 202 and exiting the nozzle 112 is sprayed onto a surface in front of the mop 100. For example, depending upon the type of the flooring surface (e.g., marble, hardwood, or tile), a compatible cleaning liquid may be selected and a bottle adapter may replace the original bottle cap, or trigger sprayer of the cleaning product before it is inserted into the bottle reservoir 110. For example, as shown in FIG. 3, in accordance with an aspect, a bottle adapter 300 may include a centrally positioned valve 302, an offset air vent 304 attached to a vent tube 306. The vent tube 306 provides a way for air to enter the bottle 202 above the level of the cleaning liquid contained therein, thereby preventing decreased pressure from interrupting the flow of cleaning liquid from the bottle 202 while also preventing the cleaning liquid from dripping from the bottle 202. Internal threads 308 of the adaptor 300 may be sized to fit the container of the cleaning product, such that the adaptor 300 may be screwed onto the bottle 202 when its original bottle cap is removed. The adaptor 300 may also include a seal, such as a resilient washer or a rubber O-ring 310 to prevent leakage when the bottle 202 is inserted in the bottle reservoir 110.

When a user clenches the spray trigger 104, cleaning liquid is drawn out of the bottle 202. The spray trigger 104 may be pivotably mounted to the handle 116 with a proximal end where it attaches the handle 116 and a distal end on the opposite side. The trigger 104 and handle 116 may be arranged such that a user's palm can rest on the top of the handle 116 and one or more of the user's fingers can clench the trigger 104 to pivot the distal end in a direction toward the handle 116. The distal end is in contact with an internal shaft (not shown), which is disposed within the upper and lower pole sections 102 and 106. As the distal end pivots during actuation of the trigger 104, it depresses the internal shaft to move it in a downward direction to open the centrally positioned valve 302 of the bottle adaptor 300. As a result, the cleaning liquid stored in the bottle 202 is drawn out, exits the nozzle 112, and is sprayed onto the floor surface in front of the mop 100. When the user releases the spray trigger 104, the internal shaft is moved upward by a reload spring and the vent tube 306 allows air to enter the bottle 202 above the level of the cleaning liquid contained therein, thereby preventing the cleaning liquid from dripping from the bottle 202. Through this process, a flow path may be created in the mop 100 that can repeatedly direct cleaning liquid to flow from the bottle 202 and exit the bottle reservoir 110 through the nozzle 112 in response to each actuation of the spray trigger 104.

Referring back to FIG. 1, the mop base 114 may have an isosceles trapezoid shape with the longer parallel line facing forward when the mop 100 is guided over a floor surface back and forth. With one side for attaching and securing a dusting pad or cleaning pad during use, the mop base 114 has an upper facing side with multiple pinchers implemented thereon, the flexible swivel head joint 118 for connecting with the bottle reservoir 110 of the lower pole section 102, and a raised portion 120 between the swivel head joint 118 and the shorter parallel line for attaching a super scrub pad. To remove caked-on soil or grime, a user can rotate the mop base 114 clockwise or counter clockwise via the swivel joint 118 to place the super scrub pad on the floor for spot cleaning.

It should be appreciated that the mop base 114 may have any of a variety of attachment features for disposable or reusable cleaning pads (e.g., microfiber pads). For example, clamping or hook-and-loop fasteners may be used.

In addition, in one aspect, the mop base 114 may be replaced with other cleaning tools such as a grout brush, a carpet brush, and adaptor for specific cleaning operations.

Figure 4:
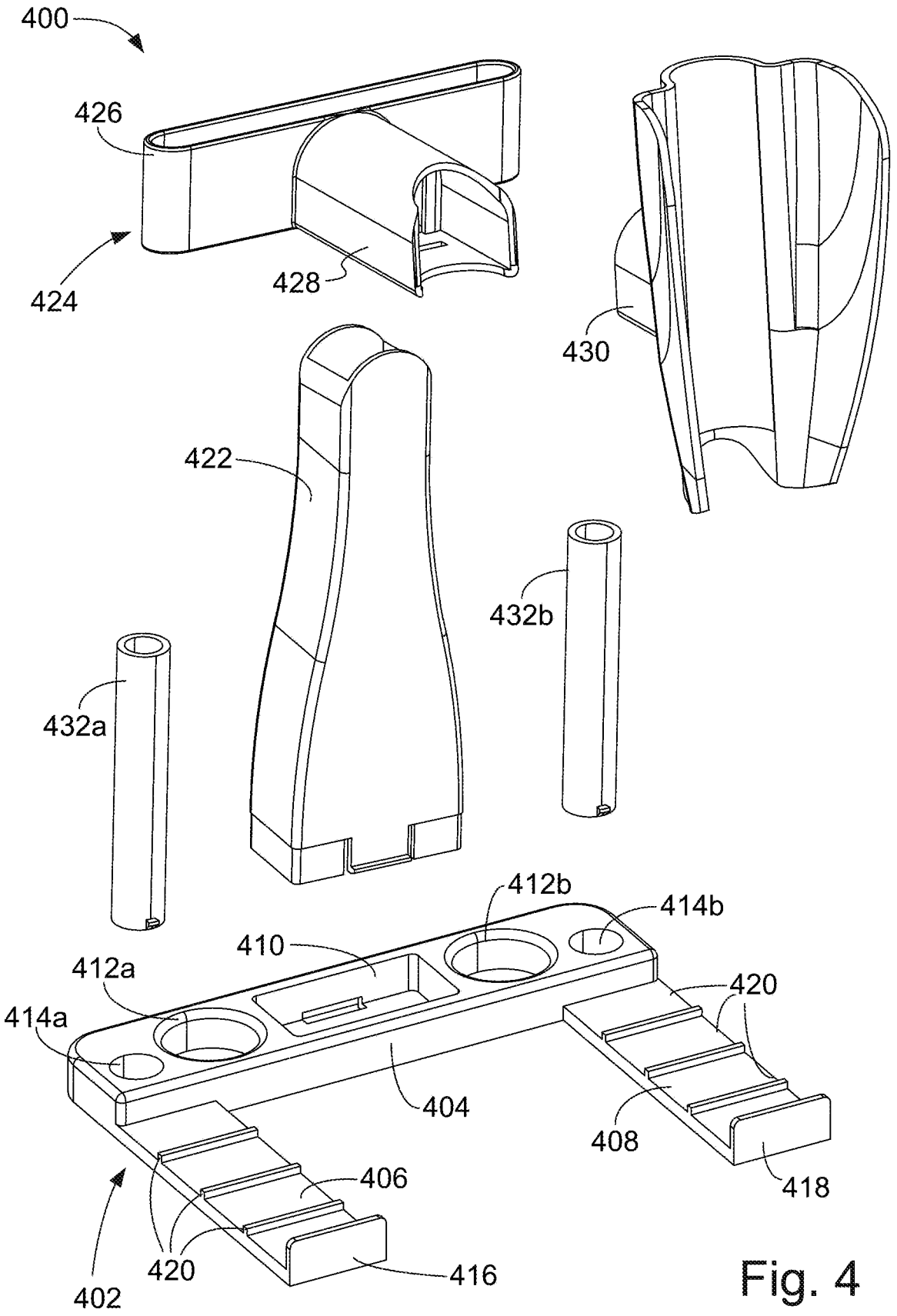
FIG. 4 illustrates a mop supporting stand, according to an exemplary aspect.

In accordance with an aspect of the present disclosure, referring to FIG. 4, a compact mop supporting stand 400 may be provided to support and maintain the multi-surface spray mop 100 described above in an upright position above a floor surface for drainage, drying and storage purposes. The mop supporting stand 400 may include a substantially U-shaped planar base 402 having a base leg 404 and two identical parallel legs 406 and 408 extending at two distal ends of the base leg 404 in a direction perpendicular to the base leg 404. A plurality of sockets may be provided on the base leg 404 and are aligned along a longitudinal axis of the base leg 404: a central rectangular cavity 410 with a first pair of annular cavities 412*a*, 412*b* at each side, and a second pair of annular cavities 414*a*, 414*b* near each distal end of the U-shaped base 402. The base leg 404 may also have two rounded corners defining the edge corners of the U-shaped base 402 with reduced footprint and enhanced aesthetic feel. Each leg 406 and 408 may have a vertical extension 416, 418 at a distal end forming a L-shape. The height of each vertical extension 416, 418 of each leg 406, 408 may be substantially equal to the thickness or height of the base leg 404. Further, each leg 406 and 408 may include a plurality of parallel ridges 420 equally spaced and positioned thereon to create slots for collecting residue water and facilitating air circulation underneath the mop base 114 when the mop base 114 with or without a cleaning pad placed thereon.

The central rectangular cavity 410 of the base leg 404 may be configured to receive a funnel support member 422 having a generally rectangular cross section. Specifically, a wider bottom opening of the funnel support member 422 fits into the central rectangular cavity 410 of the base leg 404, such that the funnel support member 422 extends vertically above the U-shaped base 402. The narrower opening at the top of the funnel support member 422 may be configured to connect with and support a T-shaped member 424. The T-shaped member 424 includes a ring sleeve portion 426 having a rounded rectangular planar cross section and a hollow tube 428 perpendicular to and intersecting the ring sleeve portion 426 at a middle portion of the ring sleeve portion 426. A cut-off portion (not shown) that has a rectangular cross section is provided on the downward facing side of the hollow tube 428 to receive and snugly fit with the narrower opening at the top of the funnel support member 422. The cross sectional profile of the hollow tube 428 may be rectangular with a rounded or hemispherical end which is slightly greater than that of a connecting portion of a mop support member 430, such that the hollow tube 428 may receive and retain the mop support member 430. The mop support member 430 has a shape complementary to that of a contact portion of the bottle reservoir 110 of the mop 100 in FIG. 1.

Furthermore, a pair of rob members 432*a*, 432*b* may be received and retained in the second pair of annular cavities 414*a*, 414*b* at each distal end of the U-shaped base 402. Each rob member 432*a*, 432*b* extends vertically above the U-shaped base 402 for holding, e.g., a grout brush via its associated brush adaptor, or other cleaning tools.

Figure 5:
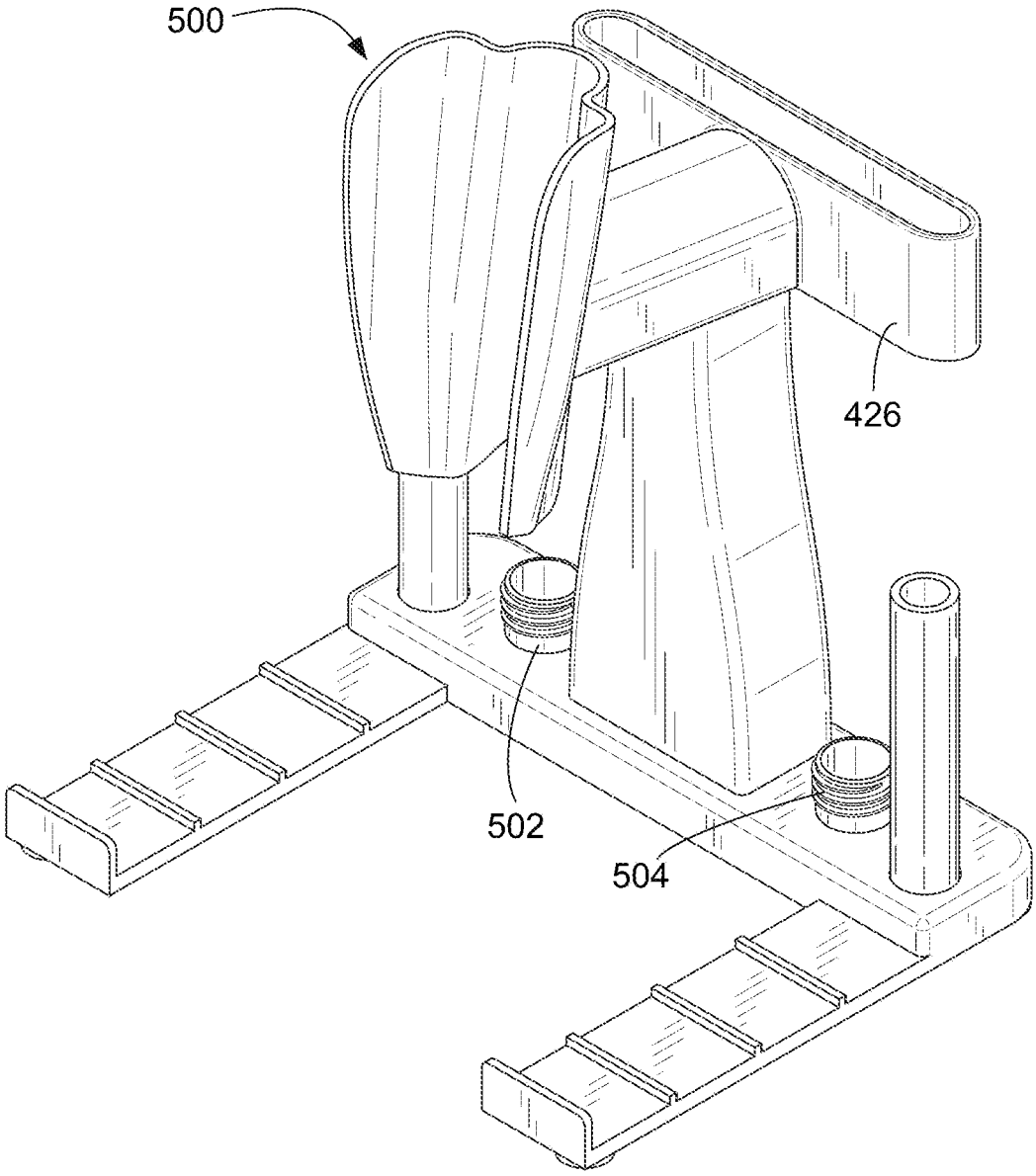
FIG. 5 illustrates an assembled mop supporting stand, according to an exemplary aspect.

According to aspects of the present disclosure, a fully assembled mop supporting stand 500 is shown in FIG. 5. When the funnel support member vertically extends above the U-shaped base and holds the T-shape member at the top, the ring sleeve portion 426 of the T-shaped member 424 may be used to insert and hang, e.g., cleaning clothes or mop pads, via its hollow interior. Additionally, the first pair of annular cavities 410*a*, 410*b* at each side of the central rectangular cavity 410 may be used to hold bottle adaptors 502, 504 described previously.

Figure 6:
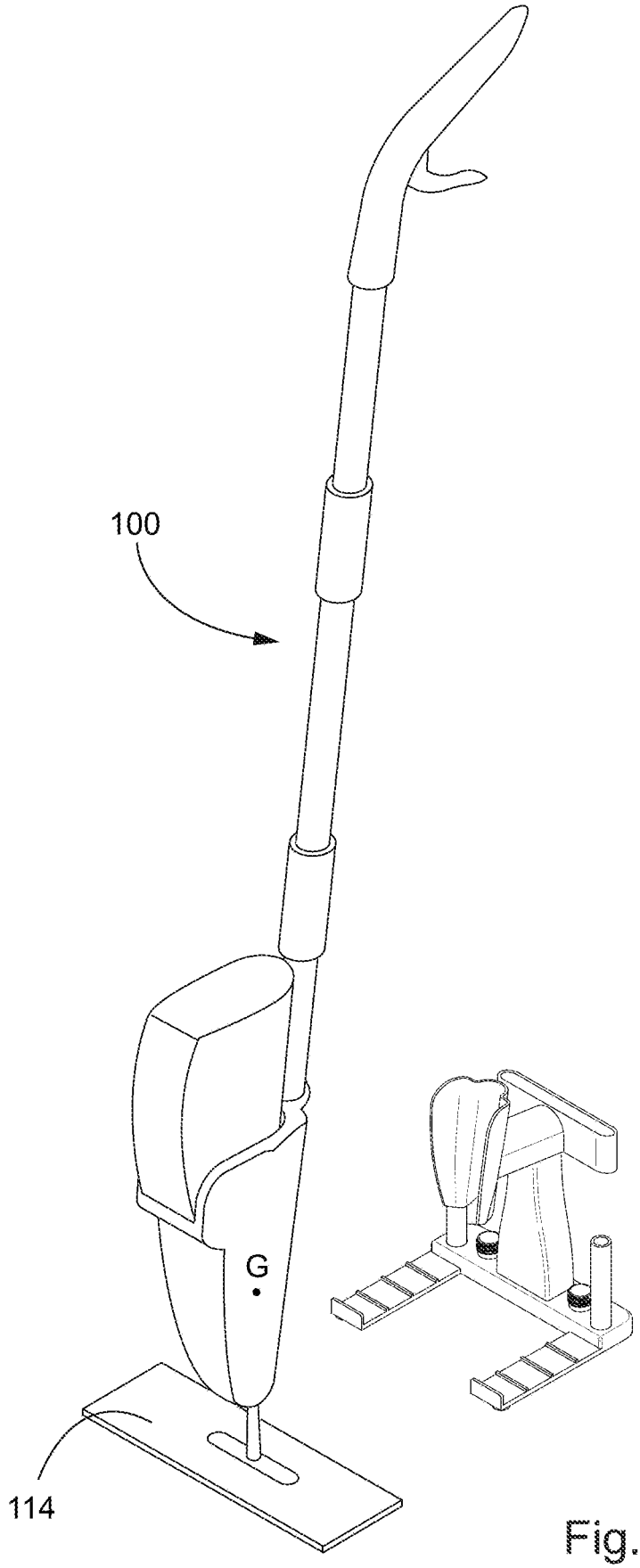
FIG. 6 illustrates a multi-surface spray mop unattached to a mop supporting stand, according to an exemplary aspect.
Figure 7:
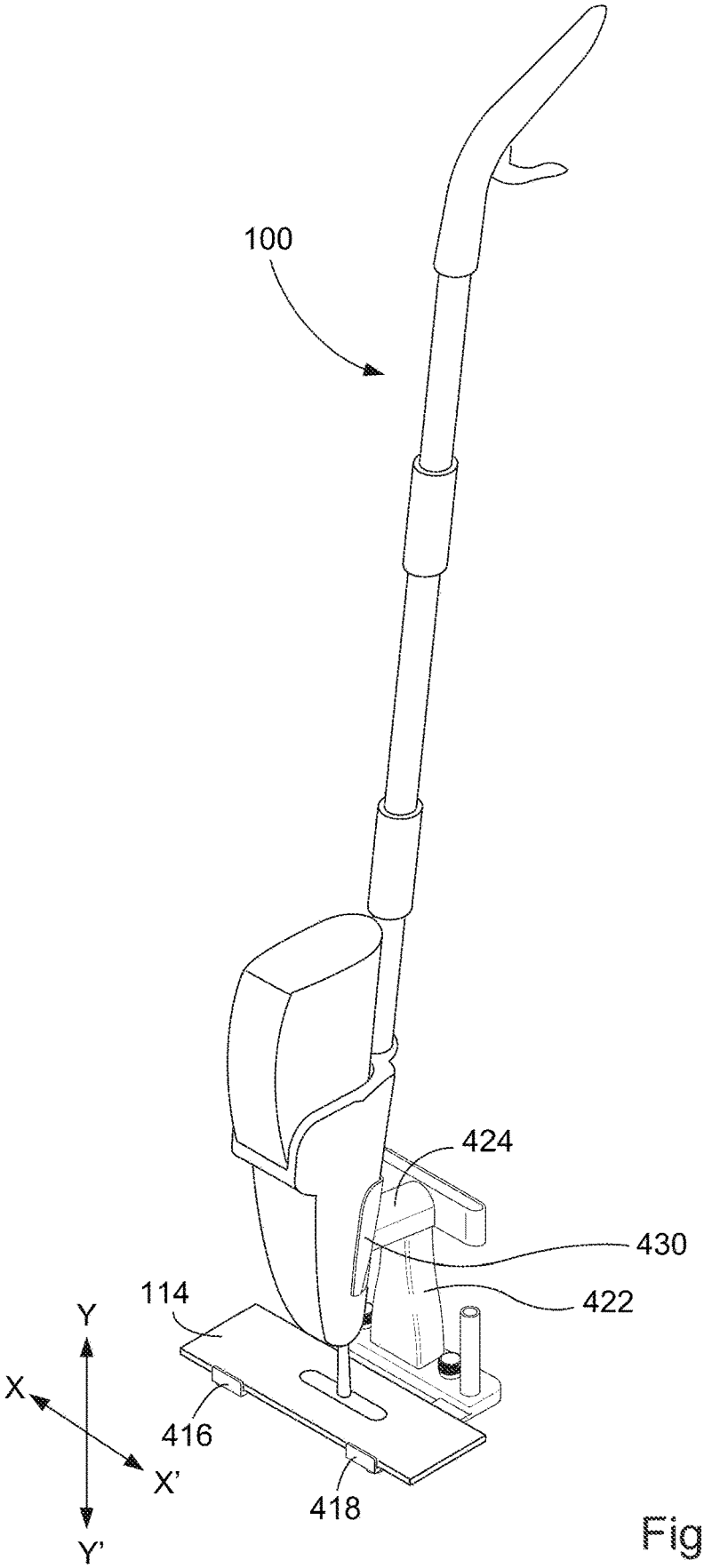
FIG. 7 illustrates a multi-surface spray mop releasably attached to a mop supporting stand, according to an exemplary aspect.
Figure 8:
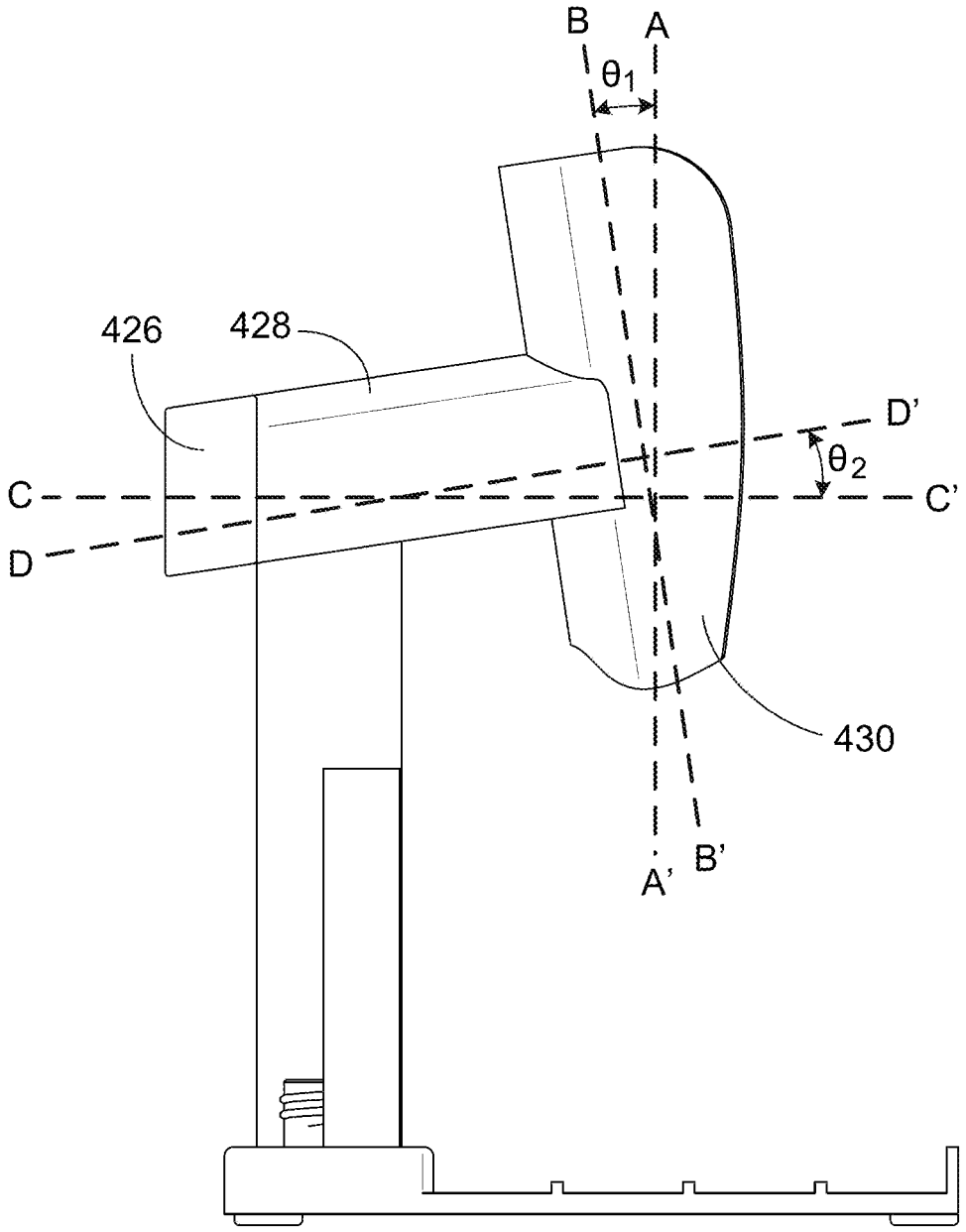
FIG. 8 illustrates a side view of a mop supporting stand, according to an exemplary aspect.

Referring to FIGS. 6-8, according to aspects of the present disclosure, a compact mop supporting stand may be provided to maintain and stabilize the multi-surface spray mop described above in an upright position on the U-shaped base 402 without using any fasteners. As shown in FIG. 6, the spray mop with or without a bottle cleaner 202 inserted in the bottle reservoir 110 does not have a uniform weight distribution, and its center of gravity (G) may be closer to where most the weight is located (e.g., approximately the middle portion of the bottle reservoir 110 depending upon the presence of the bottle cleaner and its contents). The spray mop 100, when fully assembled, may have a base of support area defined approximately by the area covered by the mop base 114, and the mop 100 is in balance if its center of gravity is above its base of support.

As shown in FIG. 7, when the mop 100 is placed on the mop supporting stand, a relatively larger base of support may be provided (the U-shaped base 402 combined with the mop base 114), and the mop 100 releasably engages with the mop support member 430 which has a shape complementary to that of the contact portion of the bottle reservoir 110. As a result, as long as the center of gravity of the mop 100 (with or without the bottle cleaner 202) remains over this increased base of support area, the force collectively exerted by the mop support member 430, the T-shaped member 424 and the funnel support member 422 in response to the weight of the leaning mop 100 may stabilize and maintain the mop 100 in an upright position, thereby reaching a stable equilibrium state.

Further, the two parallel leg 406 and 408 of the U-shaped base 402 of the mop supporting stand may also effectively maintain the mop base 114 (with or without a cleaning pad placed thereon) or the mop 110 in a stabilized upright position. For example, the length of each leg 406, 408 may be equal or slightly greater than the width of the mop base 114 in order to limit relative motions therebetween. The height of each vertical extension 416, 418 at each distal end of the legs 406, 408 may be greater than a maximum thickness of the mop base 114 (e.g., when the thickest cleaning pad or a wet cleaning pad with increased thickness is attached on), such that the mop base 114 is prevented from sliding out of the mop supporting stand at any moment. In addition, the plurality of parallel ridges 420 creates friction with the downward-facing contact surface of the mop base 114 when the mop 100 is placed on the mop supporting stand, thereby creating an additional resistance force to prevent relative motions between the mop base 114 or the mop 100 and the mop supporting stand. Such friction becomes greater when the mop base 114 has a cleaning pad attached on, as the contact surfaces therebetween become rougher.

As shown in FIG. 7, the mop support member 430 may use an irregular structure to releasably wrap around the bottle reservoir 110, thereby effectively preventing the elongated mop handle of the mop 100 from moving laterally with respect to the mop base 114 along an axis XX' when in an upright position. In one embodiment, the stable equilibrium state of the mop 100 may be the substantially perpendicular position with respect to the mop base 114 along line YY' when the support force collectively provided by one or more of the mop support member 430, the T-shaped member 424 and the funnel support member 422 and the friction collectively provided by the vertical extension 416, 418 of each leg 406, 408 and the plurality of parallel ridges 420 are in balance.

When the mop 100 deviates from the substantially perpendicular position along the line YY', it will tip over either away from the mop supporting stand or towards the mop support member 430 forming a tilt angle $\theta_1$, as shown in FIG. 8. For example, such tilt angle $\theta_1$ may be within an approximately 0-10° range formed between an axis BB' and an axis AA' that is perpendicular to the planar plane define by the U-shape base of the mop supporting stand. For example, in response to a change of the center of gravity of the spray mop 100 due to the presence or absence of bottle cleaner inside the bottle reservoir 110, the tilt angle $\theta_1$ may vary within a range of degrees to maintain the center of gravity of the spray mop 100 within the base of support area defined by the mop supporting stand in order to achieve a stable equilibrium of the mop 100 in an upright position. It should be appreciated that the range of such tilt angle $\theta_1$ may depend on the specific configuration of the mop 100 and the mop supporting stand. Correspondingly, to ensure a stable and secure connection with the mop support member 430, the T-shaped member 424 may be an angled component. Specifically, as shown in. FIG. 8, the hollow tube 428 of the T-shaped member 424 may extend upward slightly with an angle $\theta_2$ between its longitudinal axis DD' and a horizontal axis CC'. The ring sleeve portion 426 of the T-shaped member 424 may also be an angled component with, e.g., a parallelogram cross section, to flush with the hollow tube 428. Such angle $\theta_2$ may be determined based at least on the specific configuration of the mop 100 and the mop supporting stand. Angular deviation of the mop 100 when engaged with the mop supporting stand may be the result of the relative static and dynamic movement of the one or more of the constituent elements of the mop supporting stand either alone or in combination.

The above description of the disclosure is provided to enable a person skilled in the art to make or use the disclosure. Various modifications to the disclosure will be readily apparent to those skilled in the art, and the common principles defined herein may be applied to other variations without departing from the spirit or scope of the disclosure.

Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise. Thus, the disclosure is not to be limited to the examples and designs described herein but is to be accorded the widest scope consistent with the principles and novel features disclosed herein.

Insofar as the description above and the accompanying drawings disclose any additional subject matter that is not within the scope of the narrow claims presented herein, the inventions are not dedicated to the public and the right to file one or more applications to claim such additional inventions is reserved. Further, although narrow claims are presented, it should be recognized that the scope of this (or these) inventions is much broader than presented by the current claims. It is intended that broader claims will be submitted in an application that claims the benefit of priority from this application upon conversion.

The invention claimed is:

1. A device, comprising:

a substantially U-shaped base with a base leg and two parallel legs extending at two distal ends of the base leg in a direction perpendicular to the base leg;

a first member comprising a first end configured to detachably fit into a central cavity of the base leg such that the first member extends vertically above the U-shaped base;

a second member configured to detachably connect with a second end of the first member; and a third member configured to detachably connect with the second member and maintain a center of gravity of a spray mop within a base of support area defined by the device, thereby maintaining the spray mop in an upright position.

2. The device of claim 1, wherein the base leg and the two parallel legs are configured to define an area to support and maintain a mop base of the spray mop.

3. The device of claim 2, wherein each of the two parallel legs comprises a vertical extension at a distal end.

4. The device of claim 3, wherein a height of each vertical extension is greater than a thickness of the mop base.

5. The device of claim 2, wherein each of the two parallel legs has a length equal to or greater than a width of the mop base.

6. The device of claim 2, wherein each of the two parallel legs comprises a plurality of parallel ridges equally spaced and positioned thereon to create slots for collecting residue water and drying the mop base when the mop base is placed on the U-shaped base.

7. The device of claim 6, wherein the plurality of parallel ridges create surface friction to prevent relative motions between the mop base and the device.

8. The device of claim 1, wherein the base leg comprises a first pair of cavities at each side of the central cavity for holding bottle adaptors.

9. The device of claim 8, wherein the base leg comprises a second pair of cavities at each side of the central cavity, wherein the device further comprises at least a pair of rod members to be received and retained in each of the second pair of cavities, each rod member extending vertically above the U-shaped base for holding a cleaning brush.

10. The device of claim 1, wherein the second member comprises a ring sleeve portion configured to hold cleaning clothes or towels when the first member vertically extends above the U-shaped base and connects with the second member.

11. The device of claim 1, wherein the third member is configured to receive a bottle reservoir of the spray mop, wherein the bottle reservoir is configured to receive and retain a bottle cleaner that is selected for cleaning certain type of floor.

12. The device of claim 11, wherein the third member is configured to releasably engage with the bottle reservoir via complementary surface geometries of the third member and the bottle reservoir with a tilt angle $\theta_1$.

13. The device of claim 12, wherein, in response to a change of the center of gravity of the spray mop, the tilt angle $\theta_1$ varies within an approximately 3-10° range to maintain the center of gravity within the base of support area of the device.

14. The device of claim 11, wherein the third member is configured to releasably engage with the bottle reservoir to prevent a mop handle of the spray mop from moving laterally with respect to the mop base when the spray mop is in the upright position.

* * * * *